US007406784B2

(12) United States Patent
Cevenini et al.

(10) Patent No.: US 7,406,784 B2
(45) Date of Patent: Aug. 5, 2008

(54) IRONING BOARD HAVING AN IRON REST

(75) Inventors: Stefano Cevenini, Ludwigshafen (DE); Hannsgeorg Wolf, Weinheim (DE); Johannes Flath, Heidelberg (DE); Barbara Helmerking, Weinheim (DE); Carl-Uwe Tintelnot, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 10/523,562

(22) PCT Filed: Jul. 19, 2003

(86) PCT No.: PCT/EP03/07906

§ 371 (c)(1),
(2), (4) Date: Nov. 9, 2005

(87) PCT Pub. No.: WO2004/015190

PCT Pub. Date: Feb. 19, 2004

(65) Prior Publication Data

US 2006/0150449 A1 Jul. 13, 2006

(30) Foreign Application Priority Data

Aug. 2, 2002 (DE) ..... 102 35 652

(51) Int. Cl.
*D05B 81/00* (2006.01)
*D06F 79/00* (2006.01)

(52) U.S. Cl. ..... 38/107

(58) Field of Classification Search ..... 38/103, 38/104, 106, 107, 111, 137, 141, 142; 219/245, 219/247, 259; 108/28, 31, 53.5, 92–97; 248/117.1–117.7
See application file for complete search history.

(56) References Cited

U.S. PATENT DOCUMENTS

| | | | | | |
|---|---|---|---|---|---|
| 636,295 | A | | 11/1899 | Sibthorpe | |
| 662,997 | A | * | 12/1900 | Wren et al. | 38/111 |
| 868,500 | A | * | 10/1907 | Springer | 108/92 |
| 1,180,750 | A | | 4/1916 | Wolf | |
| 2,203,962 | A | * | 6/1940 | Lamb | 38/142 |
| 2,321,261 | A | * | 6/1943 | Steele | 38/75 |
| 2,333,516 | A | | 11/1943 | Brusilowski | 38/107 |
| 2,554,446 | A | * | 5/1951 | Nestor | 108/63 |
| 2,636,295 | A | | 4/1953 | Millman | 38/142 |
| 2,650,442 | A | * | 9/1953 | Johnson | 108/26 |
| 2,680,789 | A | * | 6/1954 | Robinson | 191/12 S |
| 2,723,097 | A | * | 11/1955 | Tyler | 108/28 |
| 2,739,398 | A | | 3/1956 | Carlsen | 38/107 |
| 3,250,030 | A | * | 5/1966 | Lapastora | 38/142 |
| 3,268,192 | A | * | 8/1966 | Munson | 248/117.1 |
| 3,367,611 | A | * | 2/1968 | Munson | 248/117.1 |

(Continued)

FOREIGN PATENT DOCUMENTS

DE 3009705 10/1980

(Continued)

*Primary Examiner*—Ismael Izaguirre
(74) *Attorney, Agent, or Firm*—Davidson, Davidson & Kappel, LLC

(57) ABSTRACT

An ironing board having an iron rest that is situated at the blunt end of the ironing board. The iron rest (3) is mounted on the ironing board (2) like a drawer and can be pushed in under the ironing board (2) after use.

12 Claims, 6 Drawing Sheets

U.S. PATENT DOCUMENTS

| | | | | | |
|---|---|---|---|---|---|
| 4,574,503 | A | * | 3/1986 | Bertani | 38/77.6 |
| 5,142,802 | A | | 9/1992 | Krause | 38/107 |
| 5,290,998 | A | * | 3/1994 | Couch et al. | 219/247 |
| 5,572,811 | A | * | 11/1996 | Lehrman | 38/106 |
| D546,515 | S | * | 7/2007 | Wicky et al. | D32/66 |

FOREIGN PATENT DOCUMENTS

| | | | | |
|---|---|---|---|---|
| DE | 83 17 899.6 | | | 10/1983 |
| DE | 8401510 | | | 4/1984 |
| DE | 195 26 637 | | | 12/1984 |
| DE | 29821303 | | | 3/1999 |
| DE | 199 41 494 | | | 5/2000 |
| EP | 0 458 503 | | | 11/1991 |
| EP | 0881319 | | | 12/1998 |
| FR | 1333922 | | | 6/1962 |
| GB | 2 124 661 | A | | 2/1984 |
| GB | 2178066 | | | 2/1987 |
| JP | 405309200 | A | * | 11/1993 |

* cited by examiner

IRONING BOARD HAVING AN IRON REST

BACKGROUND

Ironing boards normally in use have an ironing surface which is currently often made of expanded metal. A rest surface which is situated at the blunt end of the ironing board is provided for the iron. The iron may be placed horizontally or in an oblique position at a predefined angle here. Flexible rods fixedly attached to the iron rest are used as cable holders for the iron cord. Foldable legs which may be folded up on the bottom of the ironing board are attached underneath the ironing board. As a result, the ironing board requires little space for storage. The legs are designed such that they permit the board height to be adjusted to different heights, so that the board is adaptable to the size of the operator. Except for this possibility of height adjustment, the boards are otherwise equipped in a very inflexible manner and offer little possibility of adjustment to changed conditions.

DE 195 26 637 A1 describes an ironing board in which the iron rest has a coupling part for an extension cord which is used for conducting current from a wall outlet to the ironing board. The coupling part is designed as an outlet into which the plug of the iron cord can be inserted. The iron cord itself may pass through a cable holding device. The tensile force occurring here due to the deflection or bending of the cable holding device interferes with the ironing operation. When ironing, the cable is maximally tensioned at the narrow tip of the ironing board, where the tensile force is therefore high. In addition, when the iron is put down on the rest surface, the cable guide is easily twisted and the cable is in the way on the rest surface. The rest surface itself is formed by a sheet metal insert which receives a rotatable iron rest. The rotatable iron rest represents an improvement with respect to a rigid rest because it allows the iron to be placed oriented in different directions. However, when changing from a right-handed to a left-handed operator, the cable holding device must be changed from the left side of the iron rest to the right side.

GB 2 124 616 A describes a possibility of a different type of adjustment of the iron rest position relative to the length of the ironing board. For this purpose, the ironing board is equipped with guide strips underneath the board surface in which the iron rest may be displaced via holding rods over the ironing board in the longitudinal direction of the ironing board. In this way the iron rest may be displaced from its position at the blunt end of the ironing board over the end of the ironing board. This reduces the reach for the iron when ironing smaller pieces.

An object of the present invention is to improve the known ironing boards, in particular by reconfiguring the rest surface for the iron to thereby achieve greater safety and flexibility in handling the ironing board.

The design of the iron rest in the form of a drawer, so it may be pushed under the ironing board after use, represents an improvement with respect to the safety requirements. In addition, space is saved when storing the ironing board.

It is advantageous if it is possible to pull out the iron rest in two different pull-out positions and fix it in these positions. The first pull-out stage may be used for a normal steam iron and the second pull-out stage for a steam iron station.

To increase safety, the ironing rest is provided with an outlet for a power cord. This outlet is equipped with a switch for interrupting the current. In addition, it has a pilot lamp for indicating whether or not the switch is on. In addition, the outlet is designed at the same time as a handle for the displaceable iron rest.

For guiding the iron cord, the iron rest has a recess through which the iron cord is guided to be inserted with its plug into the outlet from below. A weight is suspended on the iron cord to tauten the cord.

The receptacle for the iron has an opening having two support flaps opposite one another, oriented obliquely to the ironing board surface and pointing downward. A further, third, support flap is preferably provided, which points upward and is an extension of one of the first two support flaps. The support flaps themselves are articulated to the side edges of the opening opposite one another via hinges, and, when not in use, may be folded into the plane of the opening. The support flaps may be fixed in the folded-in position.

Another improvement of the iron rest is achieved by the fact that it is equipped with a rotatable support for the iron. This rotatable support may be fixed at any angle.

BRIEF DESCRIPTION OF THE DRAWINGS

A plurality of exemplary embodiments of the inventive idea are illustrated in the appended drawings.

DETAILED DESCRIPTION OF THE PREFERRED EMBODIMENTS

Figure 1:
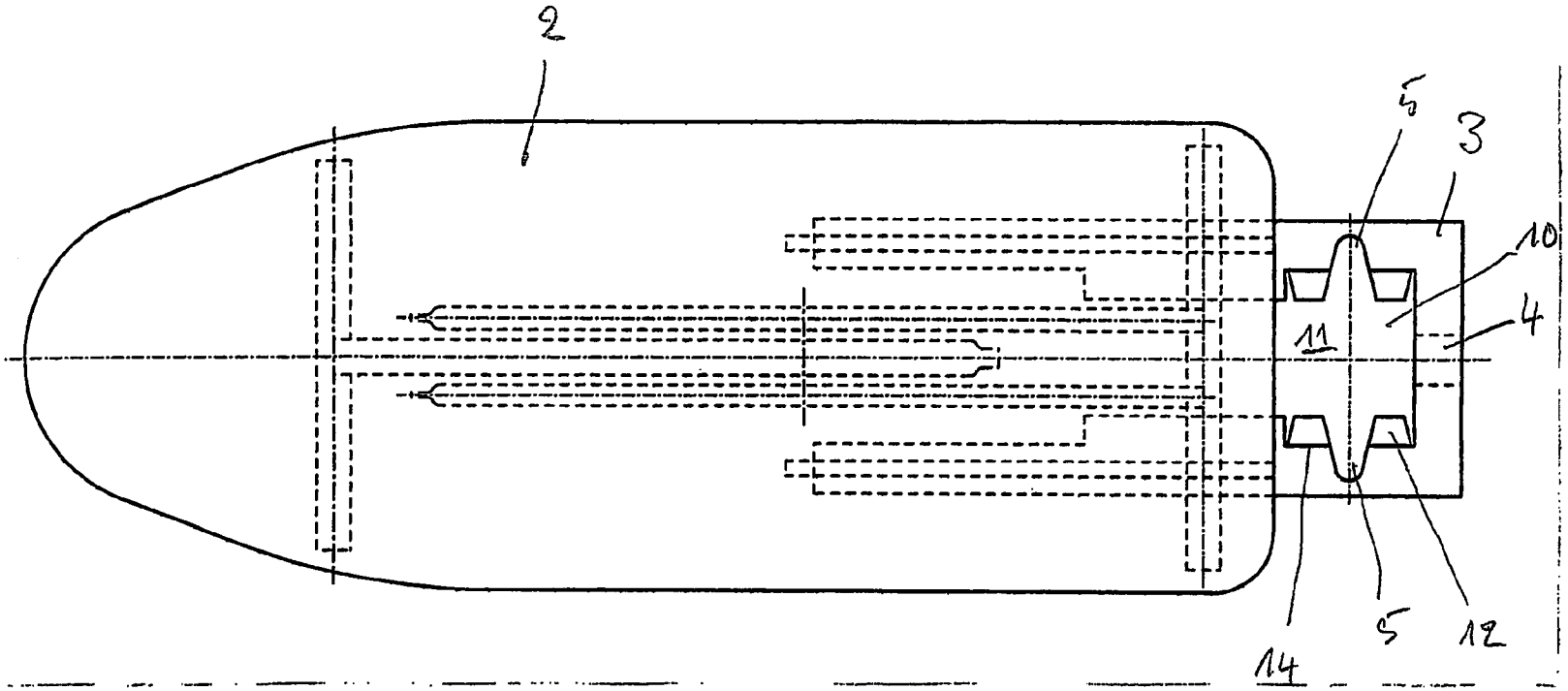
FIG. 1 shows a top view of an ironing board having a pulled-out drawer-like iron rest.
Figure 6:
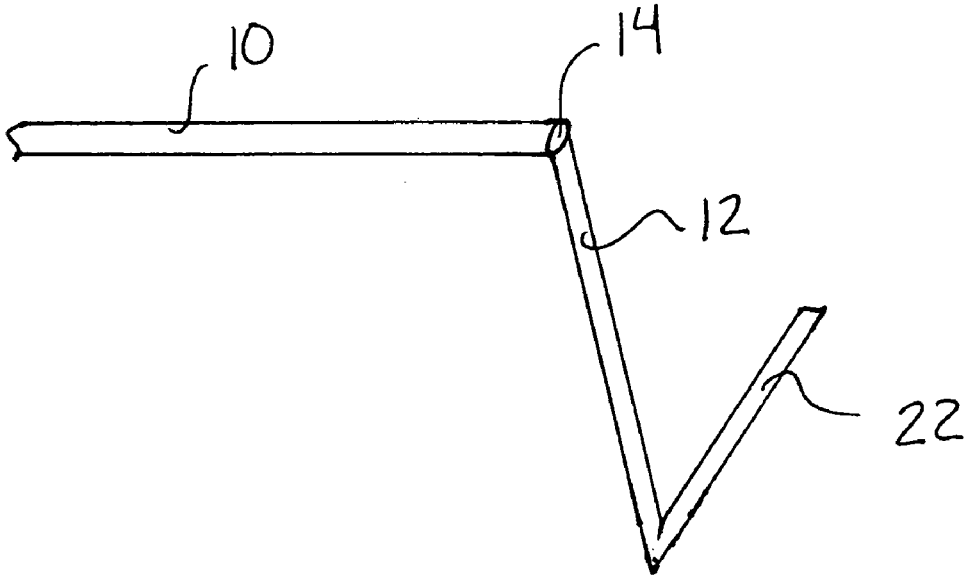
FIG. 6 shows a third support flap 22 pointing upward and forming an extension of one of the two support flaps 12.

FIG. 1 shows a top view of an ironing board 2 having iron rest 3. Iron rest 3 is attached to the body of ironing board 2 as a drawer and may be pushed in under the bottom surface of the body of the ironing board 2 when not in use. Connector 4 for a power cord is attached to the bottom of iron rest 3. Connector 4 contains at the same time a socket 24 into which the plug of iron cord 6 may be introduced. In addition, connector 4 is provided with a switch 34 for interrupting the current. The switch 34 itself is connected to a pilot light 44 which indicates that current is flowing or that the current is interrupted by the switch 34. Connector 4 is designed so that it may be used at the same time as a handle for displaceable iron rest 3. Iron rest 3 is provided with recess 5 for guiding the iron cord to connector 4. As FIG. 2 in particular shows, iron cord 6 is tensioned by a weight 7 suspended on cord 6. Support 10 for the iron is formed by opening 11 in iron rest 3, which is provided laterally with two support flaps 12 oriented obliquely to the ironing board plane and pointing downward. Support flaps 12 are articulated to opposite side edges of opening 11 via hinges 14. In this way they may be folded into the plane of opening 11 and fixed there. As shown in FIG. 6, a third support flap 22 points upward and is an extension of support flap 12.

Figure 2:
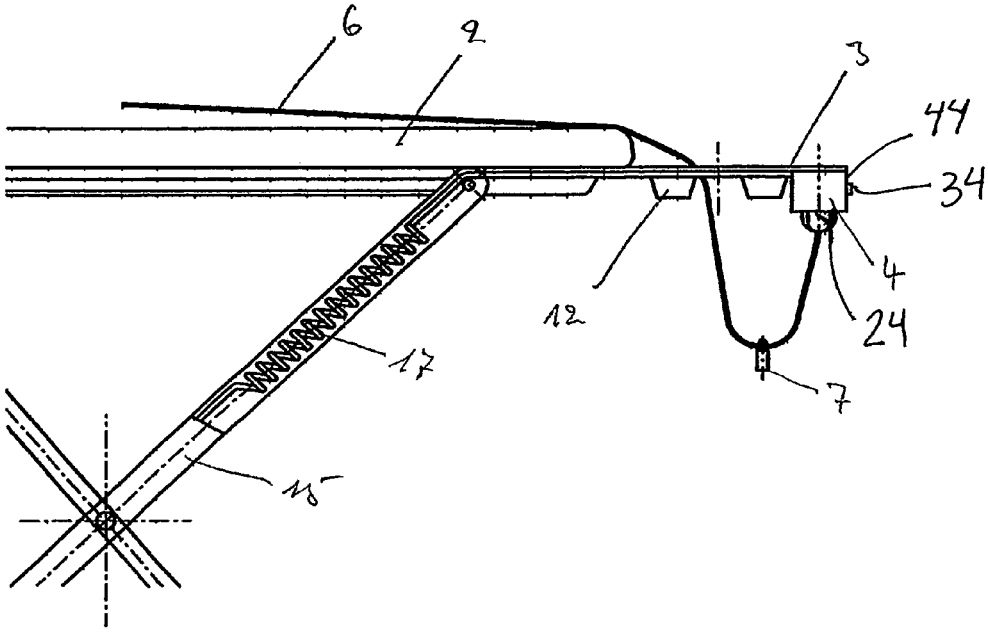
FIG. 2 shows a side view of the rear end of the ironing board of FIG. 1.

FIG. 2 shows a side view of the ironing board end, the longitudinal section of iron rest 3 being shown.

Power cord 17 is incorporated in legs 15.

Figure 3:
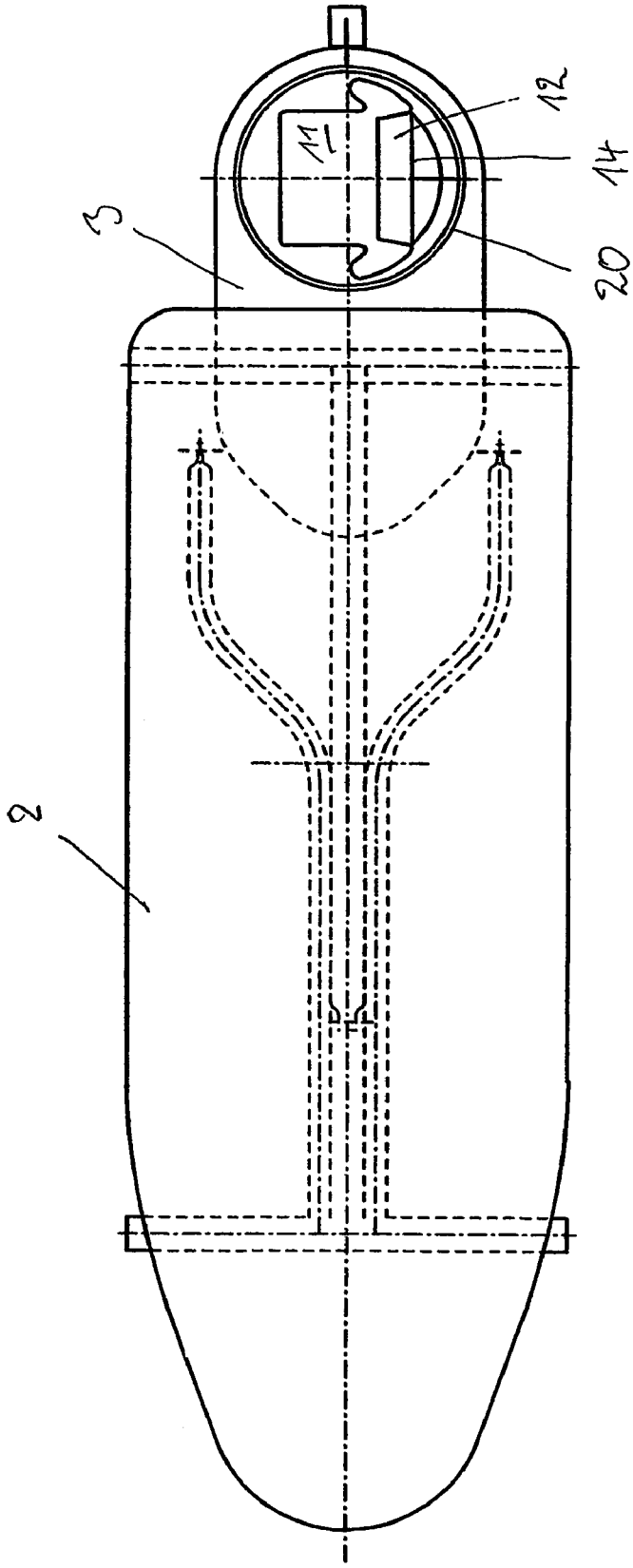
FIG. 3 shows an ironing board having an iron rest including a rotatable support for the iron.

In FIG. 3 iron rest 3 is provided with a rotatable support 20 for the iron. Support 20 has only one support flap 12 in opening 11, which is articulated to a side edge of opening 11 via hinge 14. Of course, a plurality of support flaps may also be mounted here.

Figure 4:
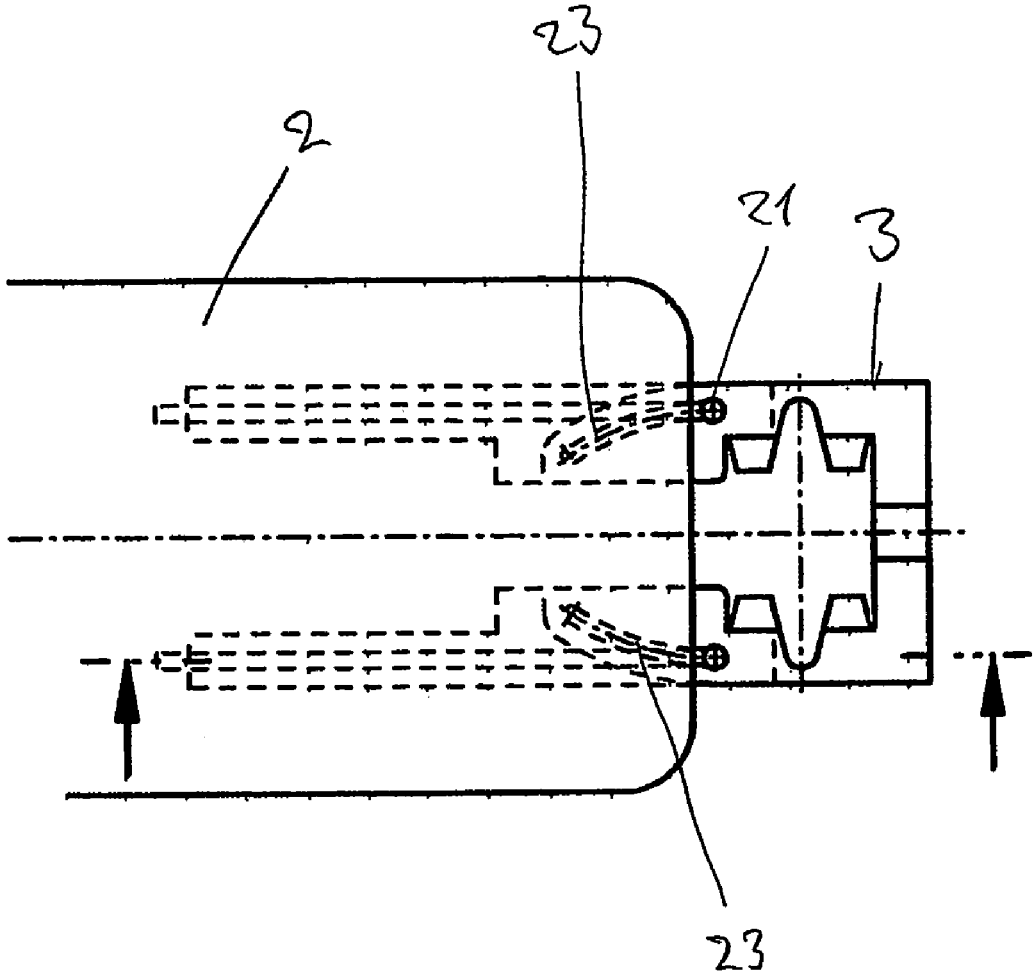
FIG. 4 shows a top view of the blunt end of the ironing board having a swiveling support for the iron.
Figure 5:
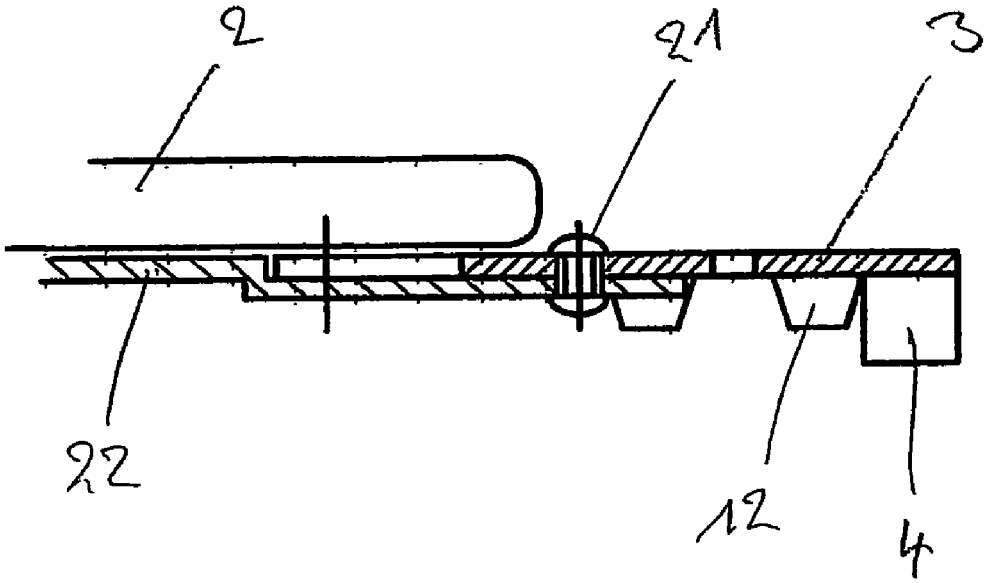
FIG. 5 shows a side view of the ironing board end according to FIG. 4.

In FIGS. 4 and 5, an ironing board 2 is shown to have a swivelable iron rest 3. For this purpose, rest 3 is provided with two rivets 21 which attach rest 3 to holding device 22 and are used at the same time as link blocks in curved slide guides 23. Rest 3 may be swiveled either to the left or to the right.

What is claimed is:

1. An ironing board comprising:

an ironing board body having a blunt end; and an iron rest at the blunt end of the ironing board body, the iron rest being mounted on the ironing board body as a drawer and being pushable under the ironing board body after use;

wherein the iron rest includes a support for the iron having an opening and having two support flaps opposite one another, the flaps oriented obliquely to a plane the ironing board body, and pointing downward;

wherein the support flaps are articulated via hinges to opposite edges of the opening and are foldable into a plane of the opening.

2. The ironing board as recited in claim 1 wherein the iron rest includes a connector for a power cord.

3. The ironing board as recited in claim 2 wherein the connector has a socket for the power cord and a switch for interrupting current.

4. The ironing board as recited in claim 3 further comprising a pilot light, the switch being connected to the pilot light.

5. The ironing board as recited in claim 2 wherein the connector includes or functions as a handle for the iron rest.

6. The ironing board as recited in claim 1 wherein the iron rest includes a recess for passage of an iron power cord.

7. The ironing board as recited in claim 6 further comprising a weight, the iron power cord being tensioned by the weight suspended on the cord.

8. The ironing board as recited in claim 1 wherein the support further includes a third support flap pointing upward and forming an extension of one of the two support flaps.

9. The ironing board as recited in claim 1 wherein the support flaps are fixed in the folded-in position.

10. The ironing board as recited in claim 1 wherein the iron rest has a rotatable support for the iron.

11. The ironing board as recited in claim 10 wherein the support is fixable at any angle.

12. The ironing board as recited in claim 1 wherein the ironing board has solely a single iron rest.

* * * * *